United States Patent [19]

Ward

[11] 4,069,845

[45] Jan. 24, 1978

[54] WIRE WRAPPING APPARATUS

[76] Inventor: Derek Ward, 11 Tui Vale Road, Auckland, New Zealand

[21] Appl. No.: 699,231

[22] Filed: June 24, 1976

[51] Int. Cl.[2] ..... B21F 15/00

[52] U.S. Cl. ..... 140/124; 140/93 R; 29/566.3; 29/751

[58] Field of Search ..... 29/203 H, 203 HT; 140/93 R, 124

[56] References Cited

U.S. PATENT DOCUMENTS

| | | | |
|---|---|---|---|
| 3,893,491 | 7/1975 | Jackson, Jr. et al. | 140/124 X |
| 3,903,935 | 9/1975 | Boothby | 140/124 |
| 3,949,944 | 4/1976 | Bent | 140/124 X |
| 3,967,661 | 7/1976 | Scoville et al. | 140/124 |

*Primary Examiner*—Willie G. Abercrombie
*Attorney, Agent, or Firm*—Holman & Stern

[57] ABSTRACT

Wire wrapping apparatus for use such as in the wrapping of an insulated single strand electrical wire around a rectangular cross-section terminal tag or post is disclosed. The present apparatus provides for the insulation to be cut or severed by an interaction between a cutting edge on the tool and a corner or ridge on the terminal tag.

9 Claims, 6 Drawing Figures

WIRE WRAPPING APPARATUS

This invention relates to wire wrapping apparatus and has been devised particularly though not solely for the wrapping of an insulated single strand electrical wire around a rectangular cross-section terminal tag or post.

In the past apparatus used for wire wrapping of terminal tags of the type used in professional electronics has either required that the piece of wire to be wrapped around the tag be cut to length and stripped of insulation along a predetermined length of the wire or else apparatus incorporating stripping facilities has had a large diameter head preventing the use of such apparatus amongst closely spaced terminal tags. Wire wrapping apparatus has also generally been complex in nature and therefore expensive to manufacture and has not been suitable for use as a simple robust hand held tool for experimental assembly or repair work.

It is therefore an object of the present invention to provide wire wrapping apparatus which will obviate or minimise the foregoing disadvantages in a simple yet effective manner or which will at least provide the public with a useful choice.

Accordingly the invention may broadly be said to consist in a tool for stripping insulated wire and wrapping that wire around a terminal tag, said tool comprising a bit having a longitudinal aperture at the end thereof adapted to engage said terminal tag, wire locating means adapted to locate and support a length of insulated wire in said bit, and a cutting edge located adjacent the mouth of said longitudinal aperture and arranged so that when a length of insulated wire is placed in said wire locating means and said aperture is engaged with said terminal tag rotation of said bit will cause the insulation on said wire to be severed partially by a corner or ridge on said terminal tag and partially by said cutting edge and the wire core to be withdrawn from the insulation which is retained in said wire locating means and wrapped about said terminal tag.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

One preferred form of the invention will now be described with reference to the accompanying drawings in which.

Figures 1, 2, 3, 4, 5, 6:
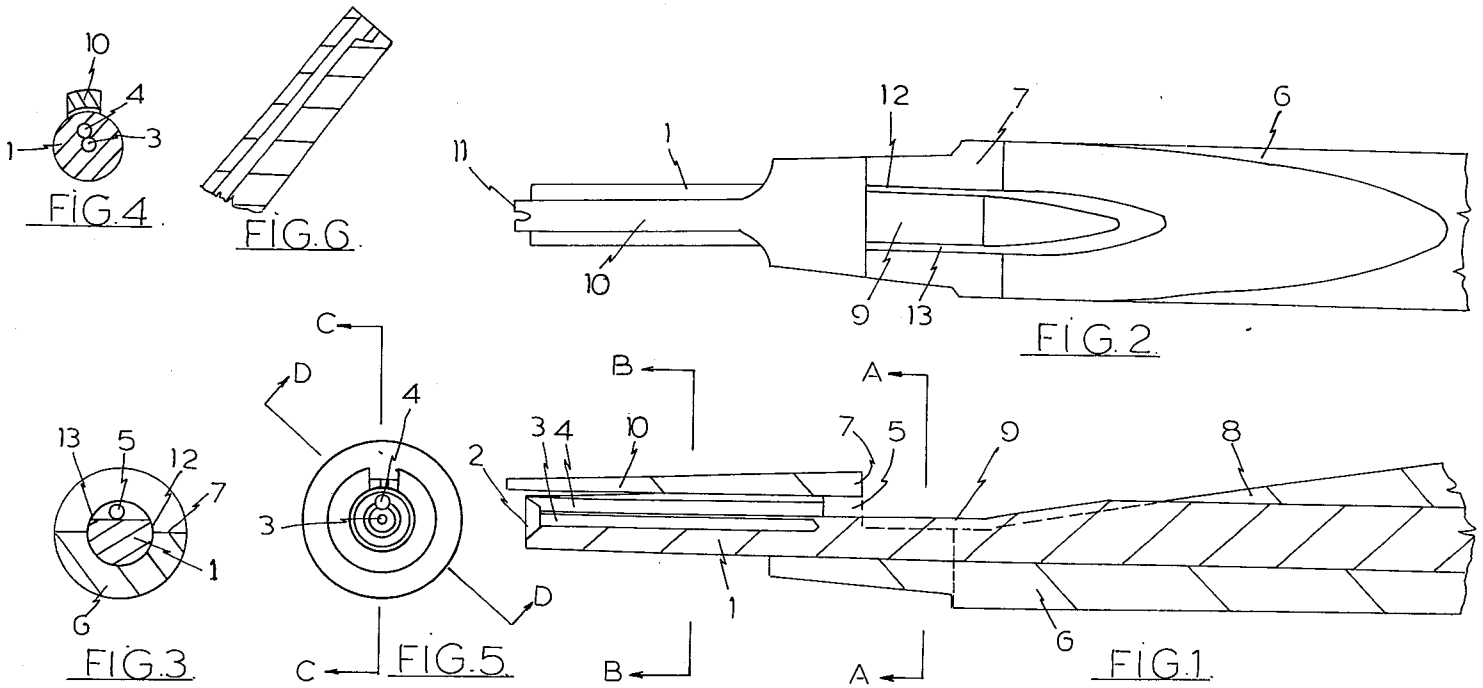
FIG. 1 is a longitudinal cross-section of wire wrapping apparatus according to the invention.
FIG. 2 is a plan view of the apparatus shown in FIG. 1
FIG. 3 is a cross-sectional view on the line A—A of FIG. 1
FIG. 4 is a cross-sectional view on the line B—B of FIG. 1
FIG. 5 is an end view of the apparatus shown in FIG. 2.
FIG. 6 is a cross-sectional view on the line D—D of FIG. 5.

In the preferred form of the invention apparatus for wrapping insulated single strand electrical wire around a rectangular tag is constructed as follows:

A bit 1 is provided in the form of a circular cross-section rod having a frusto-conical recessed portion 2 formed in one end of the rod. The sides of the frusto-conical recessed portion taper inwardly away from the end of the bit and the degree of taper can be varied from a frusto-conical recessed portion having almost parallel sides to a recessed portion having a substantial degree of chamfer on the sides. At or about the centre of the recessed portion an aperture 3 in the form of a cylindrical cavity is provided extending longitudinally into the rod substantially along the axis of the rod and of such a diameter so as to be engageable with a wrapped terminal tag. The bit is provided with wire locating means in the form of an off set hole or bore 4 having one end adjacent the aperture 3 terminating in the recessed portion 2 and arranged at an angle greater than 0° (and preferably at an angle of 2° to 3°) to the axis of the bit. The junction between the mouth of the offset hole or bore 4 and the conical side of the recessed portion 2 forms a sharp cutting edge between the wall of the bore and the side of the depression adapted in use to sever the insulation of a wire wrapped with the tool as will be described further later.

The relationship between the frusto-conical depression 2, the cylindrical aperture 3 and the offset bore 4 is such that the mouth of the offset bore pierces the curved surface forming the side of the frusto-conical depression over the entire depth of the side. The offset bore by virtue of its orientation to the axis of the rod emerges from the side of the bit some distance remote from the end of the bit for example at point 5 which may be in a recessed portion in the side of the bit as will be described further later.

In operation the end of a length of insulated single strand electrical wire that is required to form a wrapped connection with a terminal tag is inserted into the offset bore from the end of the bit member and advanced so that the end of the wire protrudes from the remote end 5 of the offset hole by an amount previously determined to give the length of wire required to be wrapped about the terminal tag. The tool is then positioned relative to the terminal tag so that the central aperture 3 is engaged with the terminal tag (ie the terminal tag is inserted into the aperture) and the end of the wire protruding from the end of the bit is located by the operator for example by holding the wire against the mounting board on which the terminal tag is mounted. The bit member is then rotated by the operator causing the wire which is restrained relative to the terminal tag to be withdrawn from the offset bore. As the wire is drawn past a corner of the rectangular terminal tag the insulation on the wire is gripped between the corner edge of the terminal tag and the cutting edge formed between the wall of the offset bore and the side curved surface of the frusto-conical depression and severed partially by the corner on the terminal tag and partly by the cutting edge. The insulation is severed by shearing or tearing between the corner and the cutting edge permitting a section of the insulation to remain within the offset bore while the wire core is pulled from the insulation by the continued rotation of the bit and wrapped around the terminal tag. After the entire length of stripped wire has been pulled from the insulation within the offset bore and wrapped around the terminal tag the tool may be removed from the terminal tag and the piece of insulation remaining within the offset bore removed by any convenient means.

In a simple form of the invention the end of the bit adapted to be held in the hand of the operator may be provided with a simple screwdriver type handle so that the bit may be rotated in the hand of the operator in a similar manner to a screwdriver. In one further form of the invention as shown in the accompanying drawings the bit member may be supported by a support member in the form of a tube 6 (which may be a complete or partial tube) the inner diameter of which is slightly greater than the outer diameter of the bit member so that the bit member forms a rotatable fit within the tube. A portion of the support tube is removed to form an opening in the form of notch 6 which ideally is formed to a depth of approximately half the diameter of the tube. The notch is formed with two faces, the longer face 8 being at an angle of approximately 20° to the axis of the tube and the shorter face being substantially at right angles to the axis of the tube. At least one edge of the opening is provided with a sharp surface 12 forming a cutting edge on the side of the opening. A recessed flat portion 9 is provided in one side of the bit member at a corresponding axial location to the opening in the support tube and the end 5 of the offset bore is arranged to emerge from the side of the bit member at this recessed portion. By virtue of the fact that there is a sharp corner formed between the flat surface of the recessed portion and the circumferential surface of the bit a further cutting edge 13 is formed at the edge of the flat recessed portion.

With this configuration of the invention, in use, when the wire is inserted into the offset hole or bore 4 and allowed to protrude from the end 5 through the opening in the support sleeve and when rotation of the bit within the sleeve is commenced, the cutting edges 12 and 13 on the sleeve and the bit coact on either side of the wire protruding through the opening to cause the wire to be cut by the cutting edges to a length desired to give the required wrap around the terminal tag.

The support tube may also be extended downwardly towards the end of the bit in extended portion 10 and provided with a notch 11 at the end of the support member so that in use the wire protruding from the end of the bit member may be engaged with the notch 11 and returned up the side of the support member to be held by the operator so that the end of the wire may be restrained in this manner relative to the terminal tag during the wrapping operation. The notch may also be used to force the wire downwardly against a mounting board on which the terminal tag is mounted so as to hold the wire relative to the mounting board and hence to the terminal tag during the wrapping operation.

Any suitable drive means may be provided to rotate the bit within the sleeve for example the tool may be provided with an electric motor drive means or an air operated drive means or alternatively some form of squeeze trigger drive mechanism may be provided adapted to be conveniently gripped in the hand of the operator to cause the bit to rotate within the sleeve when the trigger is squeezed by the operator.

In this manner a wire wrapping tool is provided which although simple and robust in construction and cheap to manufacture is suitable for the wrapping of insulated wire around rectangular terminal tags. In the simpler form of the tool a cheap hand operated screwdriver type tool is provided which is particulary suitable for intermittent experimental assembly work or for repair work where the cost of a more sophisticated wire wrapping tool would not be justified.

I claim:

1. A tool for stripping insulated wire and wrapping that wire around a terminal tag, said tool comprising a bit having a longitudinal aperture at the end thereof adapted to engage said terminal tag, the mouth of said aperture being located in a recessed portion in the end of said bit, and wire locating means adapted to locate and support a length of insulated wire in said bit said wire locating means comprising an offset hole or bore in said bit having one end terminating in the side of said recessed portion so as to form a cutting edge between the wall of said offset hole or bore and the side of said recessed portion, so that when a length of insulated wire is placed in said wire locating means and said aperture is engaged with said terminal tag, rotation of said bit will cause the insulation on said wire to be severed by the interaction of a corner of ridge on said terminal tag with said cutting edge and the wire core to be withdrawn from the insulation which is retained in said wire locating means and wrapped about said terminal tag.

2. A tool as claimed in claim 1 wherein said recessed portion comprises a frusto-conical recess having sides tapering inwardly away from the end of said bit.

3. A tool as claimed in claim 1 wherein the mouth or end of said offset hole or bore pierces the entire height of the side of said recess.

4. A tool as claimed in claim 1 wherein the axis of said offset hole or bore forms an angle greater than zero degrees with the axis of said bit member.

5. A tool as claimed in claim 1 wherein said bit is provided with a handle adapted to be turned by the hand of an operator for the rotation of said bit about said terminal tag.

6. A tool as claimed in claim 1 wherein said bit is rotatably mounted within and supported by a sleeve or partial sleeve having an opening in the side thereof provided with a cutting edge and said bit is provided with a further cutting edge adapted to coact with the cutting edge in said sleeve, said cutting edges being arranged relative to said wire locating means so that upon rotation of said bit relative to said sleeve a wire held in said wire locating means is cut by the coaction of said cutting edges.

7. A tool as claimed in claim 6 wherein said bit is provided with a recessed portion in the side thereof in an axial location corresponding to the axial location of said opening in said sleeve and said cutting edge in said bit is formed by the junction of the surface of said recessed portion with the circumferential surface of said bit.

8. A tool as claimed in claim 6 wherein at least a portion of said sleeve extends beyond the end of said bit and is provided with a locating notch adapted to engage a length of wire protruding from the end of said bit to hold and locate said length of wire relative to said sleeve.

9. A tool as claimed in claim 8 wherein drive means are provided adapted to rotate said bit within said sleeve.

* * * * *